US009061305B1

(12) United States Patent
Martinez

(10) Patent No.: US 9,061,305 B1
(45) Date of Patent: Jun. 23, 2015

(54) FIRE SPRINKLER PAINT PROTECTOR

(71) Applicant: Richard Martinez, Altamonte Springs, FL (US)

(72) Inventor: Richard Martinez, Altamonte Springs, FL (US)

( * ) Notice: Subject to any disclaimer, the term of this patent is extended or adjusted under 35 U.S.C. 154(b) by 121 days.

(21) Appl. No.: 13/973,624

(22) Filed: Aug. 22, 2013

Related U.S. Application Data

(60) Provisional application No. 61/693,075, filed on Aug. 24, 2012.

(51) Int. Cl.

| | |
|---|---|
| ***B05B 15/00*** | (2006.01) |
| ***B05B 15/04*** | (2006.01) |
| ***B05C 21/00*** | (2006.01) |
| *A62C 31/28* | (2006.01) |

(52) U.S. Cl.
CPC ..... *B05B 15/001* (2013.01); *B05B 15/0462* (2013.01); *A62C 31/28* (2013.01); *B05B 15/045* (2013.01); *B05B 15/04* (2013.01); *B05C 21/005* (2013.01)

(58) Field of Classification Search
CPC .. B05B 15/04; B05B 15/045; B05B 15/0462; B05B 15/001; B05C 21/005; A62C 31/28
USPC ..... 118/504, 505; 169/37, 42, 51, 57
See application file for complete search history.

(56) References Cited

U.S. PATENT DOCUMENTS

| | | | | |
|---|---|---|---|---|
| 4,825,805 | A * | 5/1989 | Walker | 118/504 |
| 6,484,809 | B1 * | 11/2002 | Elder | 169/37 |
| 2008/0197133 | A1 * | 8/2008 | McKay et al. | 220/359.1 |
| 2009/0271967 | A1 * | 11/2009 | Orr | 29/428 |

* cited by examiner

*Primary Examiner* — Laura Edwards
(74) *Attorney, Agent, or Firm* — H. John Rizvi; Gold & Rizvi P.A.

(57) ABSTRACT

The present invention relates to a paint guard and installation tool for use in protecting sprinkler heads of an automatic sprinkler system when painting ceilings. The paint guard includes a magnet for releasably engaging with an annular metal rim of the sprinkler head to provide a tight seal and prevent paint from coming into contact with the sprinkler head. The installation tool provides a quick and easy hands-free method of installing and removing the paint guard.

20 Claims, 4 Drawing Sheets

FIRE SPRINKLER PAINT PROTECTOR

CROSS-REFERENCE TO RELATED APPLICATION

This Non-Provisional Utility application claims the benefit of U.S. Provisional Patent Application Ser. No. 61/693,075, filed on Aug. 24, 2012, which is incorporated herein in its entirety.

FIELD OF THE INVENTION

The present disclosure generally relates to accessories for use in painting residential and commercial buildings. More particularly, the present disclosure relates to a paint guard and installation tool use in protecting sprinkler heads of an automatic sprinkler system when painting ceilings. The paint guard includes a magnet for providing a tight seal when attached to the metal annular rim of a sprinkler head to prevent paint from coming into contact with the sprinkler head. The installation tool provides a quick and easy hands-free method of installing and removing the paint guard.

BACKGROUND OF THE INVENTION

Laws and regulations have been adopted to require certain private and public buildings to implement automatic sprinkler systems. Automatic sprinkler systems generally include a plurality of sprinkler heads that are coupled to a water supply, via pipes and operated to extinguish flames with water in the event of a fire. Sprinkler heads are typically oriented in ceilings, walls or in other parts of a building to provide a predefined zone of protection. There are a variety of sprinkler heads available on the market today. One common sprinkler head includes a glass vial that is designed to expand and burst when exposed to heat. The glass vial bursts and activates the sprinkler system allowing water to extinguish the flames. The sprinkler system is often inspected to insure proper operation and to replace defective or damaged sprinkler heads. When it comes to painting the ceiling of buildings, painters are required to paint around the sprinkler heads being careful not to apply paint to the heads possibly clogging or fouling the operation of the sprinkler heads.

Painters generally utilize a variety of accessories to better assist them in painting both residential and commercial buildings. For example, painters use paintbrushes, stepladders, drop cloths, scrappers and paint trays when painting walls, doors, and windowpanes of buildings. Painters also utilize rollers and spray guns to efficiently paint ceilings of commercial buildings to cover a greater surface area in a shorter period of time when compared to paint brushes. When spraying the ceiling with paint, painters have to be cautious not to cover the sprinkler heads with paint. Applying paint to the sprinkler's glass vial can compromise the operative function of such devices. In addition, paint left on the outer rims of sprinkler heads dilutes the aesthetic appearance of a freshly painted ceiling. Upon inspection, building owners are often faced with having to replace painted or stained sprinkler heads thereby increasing the cost of parts and labor. To overcome the burden of indirectly applying paint to sprinkler heads, a variety of devices and methods have been adopted to assist painters in protecting sprinkler heads when painting ceilings.

One method involves wrapping each sprinkler head with a plastic wrap or bag. The method includes the use of masking tape and a thin plastic sheet where the plastic sheet is taped securely around each sprinkler head to cover the device. After the paint job is completed, the plastic wrap is simply torn off each sprinkler head. The method has proven to be time consuming and burdensome. In an effort to lessen the burden, paint guards have been developed to cover sprinkler heads. Some prior art paint guards include conical shaped devices including an open end and a closed end. Adhesive material is typically applied along the outer surface area of the guard's open end to permit the paint guard to stick to the annular rim of the sprinkler head. Such prior art paint guards however, provide limited use. For example, the adhesive material is often compromised during use thereby preventing a tight seal between the paint guard and annular rim of the sprinkler head. Paint mist enters the non-sealed areas allowing paint to come in contact with the sprinkler head. Also, when the paint guard is removed, the adhesive material often remains on the annular rim of the sprinkler head requiring the painter to use solvents to remove the residue. In addition, paint guards with adhesive are often used for one time only. The adhesive material deteriorates over time as a result of repeated use. Further, such paint guards require individuals to climb latters when installing each paint guard. The process of attaching conventional paint guards by hand is time consuming and dangerous.

Other conventional paint guards have been designed to help protect sprinkler heads of automatic sprinkler systems without the need of having to climb latters to install the paint guards. Such traditional paint guards generally comprise a guard including a cover having a threaded aperture, or a fastener opening. An installation tool comprising an elongated handle that includes a threaded end engages with the threaded aperture of the paint guard. A user inserts the threaded end of the tool into the threaded aperture of the paint guard and threads the tool onto the paint guard. After the paint guard is attached to a sprinkler head, the user unthreads the handle to detach the installation tool from the paint guard. Still other conventional paint guards include apertures that are formed within the body of the paint guard and adapted to receive the end of a tool. The end of the tool is simply inserted within the paint guard and the paint guard is lifted to the ceiling to cover a sprinkler head. The tool is either reinserted within the aperture in an attempt to remove each paint guard, or the painter must have access to a latter to reach each paint guard by hand.

Such conventional paint guards provide certain drawbacks. For example, a user must unthread the installation tool from the paint guard after the guard has been attached to the sprinkler head. The force in unthreading the installation tool often results in the paint guard detaching from the sprinkler head. Also threading and unthreading the installation tool to paint guards is time consuming. Conventional paint guards having non-threaded apertures formed in the body also pose a problem. For example, when elevating such paint guards to the ceiling, the paint guards often sway back and forth on the tip of the installation tool making it difficult to securely attach the paint guard over the sprinkler head. Also, after such conventional paint guards are installed over sprinkler heads, and the ceiling is painted, paint often enters the apertures of the paint guards thereby compromising the threads or blocking the aperture of the paint guards. The user has difficulty inserting the tip of the installation tool within the paint guard, or must resort to the use of a latter to remove the paint guards by hand. Thus, though conventional installation tools and paint guards alleviate the need of having to climb a latter to install the paint guards, the combinational use of such traditional paint guards and installation tools is time consuming, burdensome, and impractical to use.

What is desired is a paint guard and installation tool that is easy and practical to use, and provides a paint guard that attaches securely to annular rims of sprinkler heads to create a tight seal to prevent debris and paint from coming into contact with the sprinkler head. What is also desired is a paint guard and installation tool that provides painters a hands-free method of installing and removing paint guards from the floor without the need for climbing a latter or requiring assistance.

SUMMARY OF THE INVENTION

The basic inventive concept provides, in combination, a paint guard and installation tool for securely attaching a paint guard to the outer rim of a sprinkler head to protect the sprinkler head when painting ceilings of residential or commercial buildings.

A first aspect of the present invention provides, a paint guard and installation tool for protecting sprinkler heads of an automatic sprinkler system, the paint guard and installation tool, in combination, comprising:

- the sprinkler head paint guard comprising:
  - a base having a peripheral edge,
  - a tubular wall extending between a first tubular wall end and a second tubular wall end, the first tubular wall end extending generally perpendicularly from the base peripheral edge, and
  - a flange extending radially outward from the second tubular wall end defining an attachment surface, wherein the flange is bound by an outer peripheral edge, the flange being sized to engage with an mounting flange of a fire fighting sprinkler head assembly, and
  - a magnetized material carried by the flange attachment surface,
  - wherein the tubular wall and the base define a receptacle extending inward from the second tubular wall end and the receptacle having a size and shape adapted to cover a sprinkler head of the fire fighting sprinkler head assembly; and
- an installation tool including:
  - an outer sleeve having a longitudinal aperture extending axially through a central region of the outer sleeve;
  - an inner shaft slidably assembled within the longitudinal aperture, the inner shaft extending between a shaft operational end and a shaft user interface end;
  - a pair of gripping arm subassemblies, each gripping arm subassembly comprising:
    - an operational outer control arm segment extending between an operational control arm affixed end and an operational control arm free end, wherein the operational control arm affixed end is coupled to the outer sleeve;
    - an inner control arm segment extending between an inner control arm affixed end and an inner control arm free end, wherein the inner control arm affixed end is coupled to the elongated inner shaft and the inner control arm free end is affixed to the operational outer control arm segment proximate the operational control arm free end;
    - a gripping arched section carried by at least one of:
      - the operational outer control arm segment at a location proximate the operational control arm free end, and
      - the inner control arm segment at a location proximate the inner control arm free end; and
  - wherein the inner shaft is manipulated to force the gripping arched sections to releasably engage an exterior surface of the tubular wall of the sprinkler head paint guard.

In a second aspect of the invention, the inner shaft includes a handle disposed at the proximal end of the shaft and the installation tool further includes a collar coupled to the sleeve and receiving an end of each arm, the end of each arm adapted to pivot within the collar.

In another aspect, the base, tubular wall, and flange can be fabricated having circular cross sectional shapes.

In another aspect, the base and the tubular wall are fabricated having a unitary construction.

In another aspect, the base, the tubular wall, and the flange are fabricated having a unitary construction.

In another aspect, the magnetized material is embedded within the flange.

In another aspect, the magnetized material is provided in a form of a frame extending between an inner peripheral edge and an outer peripheral edge, the magnetized material frame being assembled to the flange attachment surface.

In yet another aspect, the gripping arched section further comprising a concave surface.

In yet another aspect, the gripping arched section further comprises a friction enhancing material disposed upon the gripping surface.

In yet another aspect, the inner shaft further comprising a handle carried by the inner shaft user interface end of the shaft.

These and other advantages of the invention will be further understood and appreciated by those skilled in the art by reference to the following written specifications, claims, and appended drawings.

BRIEF DESCRIPTION OF THE DRAWINGS

The invention will now be described, by way of example, with reference to the accompanying drawings, in which.

Like reference numerals refer to like parts throughout the various views of the drawings.

DETAILED DESCRIPTION OF THE INVENTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 1:
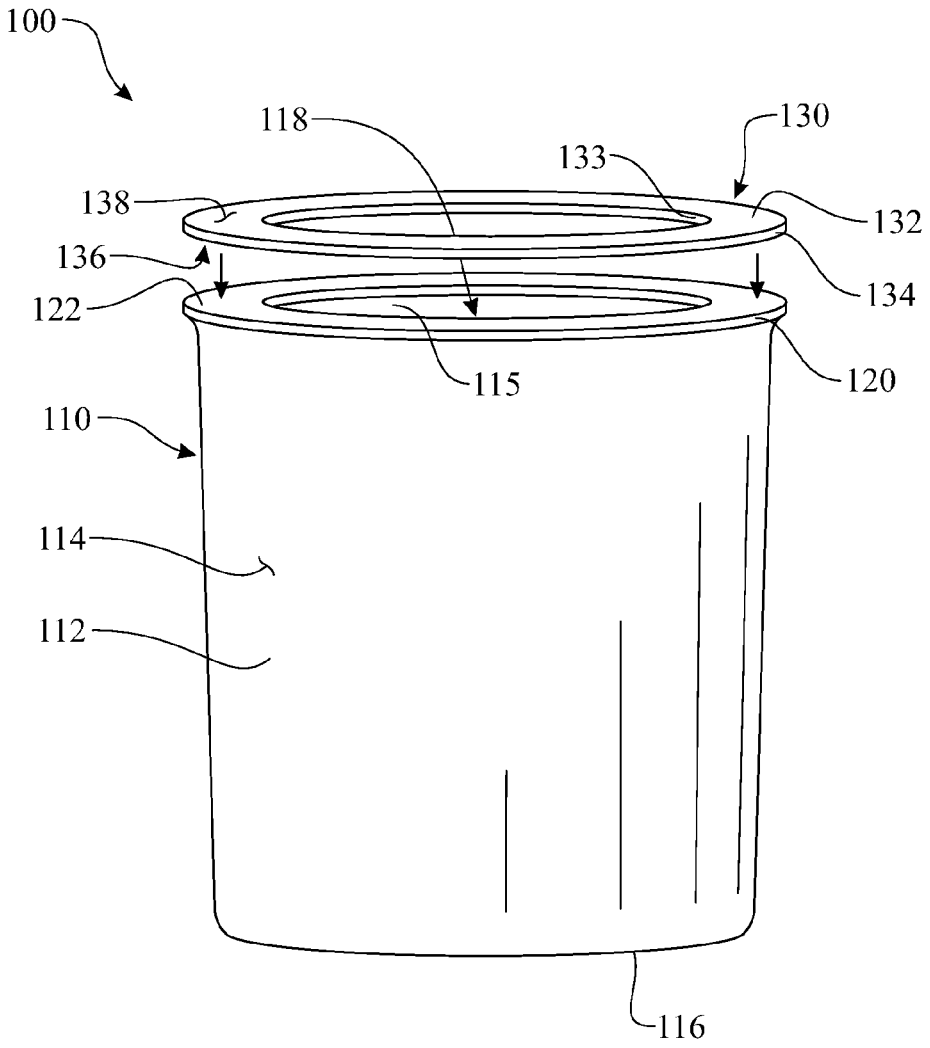
FIG. 1 presents a front isometric exploded assembly view of an exemplary paint guard showing a magnetic member removably attached to an annular flange of the paint guard, in accordance with the embodiment of the present invention.
Figure 2:
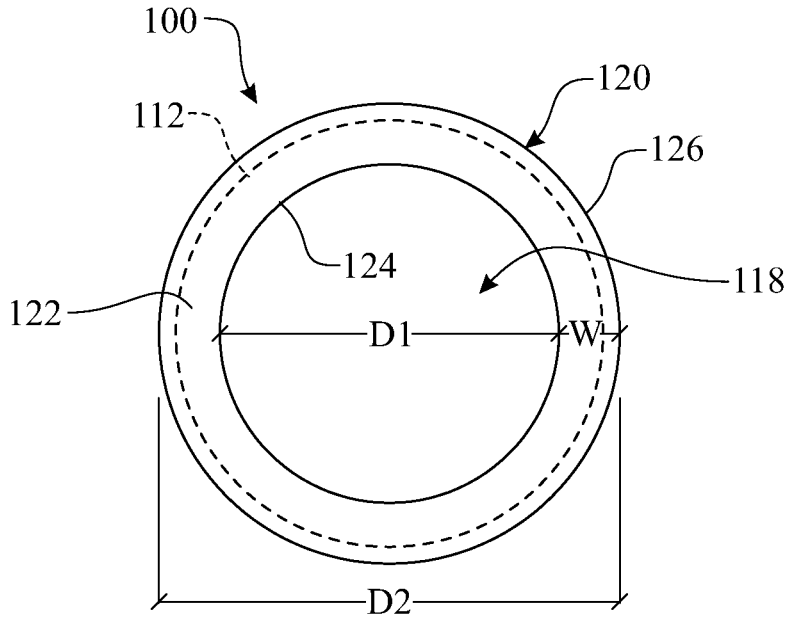
FIG. 2 presents a top dimensioned view of the paint guard of FIG. 1.
Figure 3:
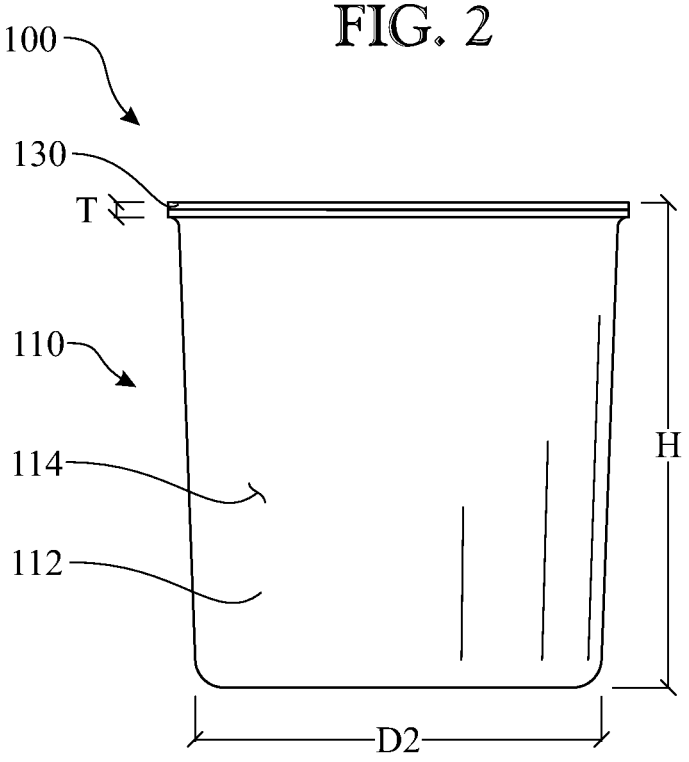
FIG. 3 presents a side dimensioned view of the paint guard of FIG. 1.

Referring to the drawings, particularly, FIGS. 1-3 there are shown an isometric front view, a dimensioned top view, and a dimensioned side view of an exemplary sprinkler head paint guard 100, in accordance with the embodiment of the present invention. The sprinkler head paint guard 100 includes a cylindrical body 110 comprising a circular wall 112, a base 116, and an annular flange 120.

The circular wall 112 forming a tubular structure extending generally perpendicularly from a peripheral edge about the base 116. The annular flange 120 extends radially outward from a top perimeter of the circular wall 112 defining an attachment surface 122 extending between an inner annular peripheral edge 124 and an outer annular peripheral edge 126. The attachment surface 122 of the annular flange 120 is preferably planar. The resulting cylindrical body 110 defines a receptacle 118 having an open end defined by an inner annular peripheral edge 124 and a closed bottom defined by the body base 116. The cylindrical body 110 can be formed as a using any suitable unitary fabrication process, including a drawing process, a spinning process, a progressive stamping process, a progressive punching process, an injection molding process, a machining process, thermoforming, blow molding, vacuum forming, and the like. Alternatively, the cylindrical body 110 can be formed as a using any suitable multi-part fabrication process, including molding, extrusion, machining, and the like. The multiple elements would subsequently be joined together forming a single body assembly.

Figure 5:
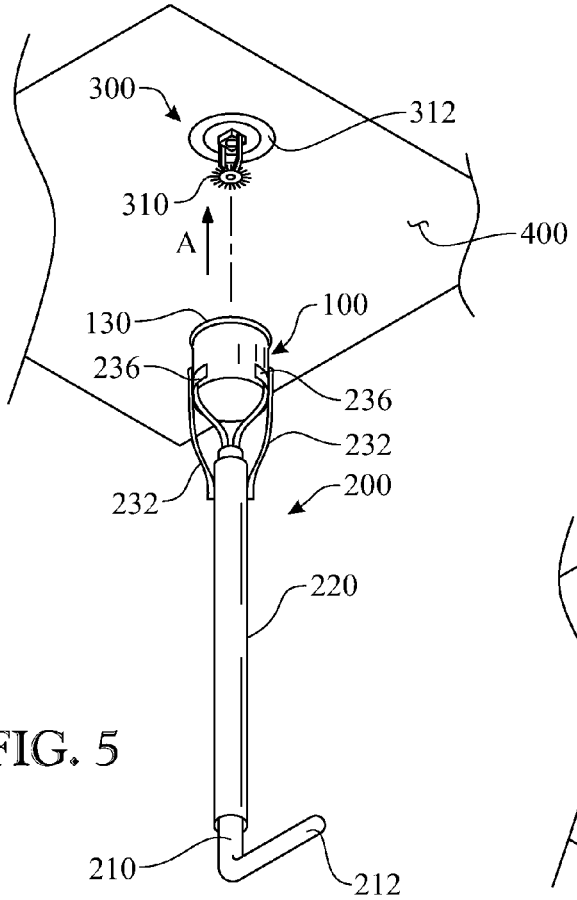
FIG. 5 presents an isometric view of the paint guard releasably held by the installation tool and oriented to attach the paint guard to the annular rim of a sprinkler head located on a ceiling, in accordance with the present invention.

The sprinkler head paint guard 100 is dimensioned to allow its application or placement over a sprinkler head assembly 300 of a fire sprinkler system generally installed in private or public establishments. For illustrative purposes, a sprinkler head assembly 300, as shown in FIG. 5, is installed in a ceiling 400. Sprinkler head assemblies 300 can be installed in ceilings 400, walls or in other structures of buildings. Each sprinkler head assembly 300 commonly comprises a sprinkler element 310 mounted within an annular mounting ring 312.

It is possible that the sprinkler head paint guard 100 of the present invention is offered having other geometrical shapes that enable the sprinkler head paint guard 100 to be used with sprinkler heads having different sizes, shapes or configurations. For example, the sprinkler head paint guard 100 can include a frustum shape having a large open end and a narrower closed bottom. The sprinkler head paint guard 100 is preferably constructed from a durable, rigid or semi-rigid material such as plastic, wood, ceramic, acrylic, composite, glass, or metal. The material selected in constructing the sprinkler head paint guard 100 should provide a receptacle 118 having an integral structure designed to securely cover a sprinkler head assembly 300 and withstand exposure to a variety of chemicals such as paint.

The annular flange 120 includes a flat or planar attachment surface 18 extending between an outer edge and an inner edge. The flat attachment surface 122 is designed to engage with an annular mounting ring 312 of a sprinkler head assembly 300. In one embodiment, sprinkler head paint guard 100 includes a circular wall interior surface 115 that extends downwards from the inner edge 124 of the flat attachment surface 122 to provide a sprinkler head paint guard 100. The circular wall interior surface 115 is preferably sized having an inner diameter D1 of approximately 1⅞ inches. The circular wall interior surface 115 can extend partially or totally within the receptacle 118 of the sprinkler head paint guard 100. In one non-limiting embodiment, the flat attachment surface 122 is 9/16 of an inch in width (W), as better illustrated in FIG. 2. The width (W) of the annular flange 120 is selected to provide an optimum seal between the sprinkler head paint guard 100 and annular mounting ring 312 of a sprinkler head assembly 300 when the sprinkler head paint guard 100 is attached to the annular mounting ring 312.

The sprinkler head paint guard 100 includes an annular magnet 130 that is securely attached to the attachment surface 122 of the annular flange 120. The 130# comprises a 136# on a first side and a 138# on an opposite side, wherein the surfaces 136, 138 extend between an inner magnet annular peripheral edge 133 and an outer magnet annular peripheral edge 134. The surfaces 136, 138 are preferably designed having a planar surface. The annular magnet 130 can be securely attached to the attachment surface 122 using any suitable adhesive or bonding material. Alternatively, the annular magnet 130 can be securely attached to the attachment surface 122 using any suitable mechanically joining elements, such as screws, bolts, rivets, clips, clamps, mechanical interface, twist lock, snaps, and the like. The annular magnet 130 can comprise a width (analogous to the reference "W" of the attachment surface 122) that is smaller, equal to or larger than a width (identified by a reference "W") of the attachment surface 122. In the preferred embodiment, the annular magnet 130 comprises an annular ring that corresponds to the size and shape of the attachment surface 122 and to the annular mounting ring 312 of a sprinkler head assembly 300. The annular magnet 130 is selected to provide a tight seal between the sprinkler head paint guard 100 and the annular mounting ring 312 to prevent paint and/or other debris from coming into contact with the sprinkler head assembly 300, wherein the paint and/or other debris from possibly causing damage, clogging the device, or causing any other unfavorable condition. The annular magnet 130 is preferably a permanent magnet having strong magnetized properties. In one exemplary embodiment, the annular magnet 130 can comprise neodymium Iron Boron, (NdFeB or NIB), Samarium Cobalt (SmCo), or other well-known materials. In one non-limiting example, the annular magnet 130 can comprise a thickness (identified by a reference "T") of approximately 3/16 of an inch.

It is understood that the annular magnet 130 is a preferred embodiment, and that the magnet 130 can be provided in any suitable shape, including a non-annular configuration having any suitable dimension. In one alternative example, the magnet 130 can comprise a plurality of magnets that are situated on attachment surface 122, such as a series of magnets spatially arranged about the annular flange 120. In another alternative embodiment, the annular magnet 130 can comprise magnetic particles that are completely embedded within the attachment surface 122 of the annular flange 120. In another example, magnetic particles can be included within the plastic material that forms the body of the sprinkler head paint guard 100. The embedded magnetic particles eliminate the need of having to separately attach the annular magnet 130 to the attachment surface 122 of the sprinkler head paint guard 100 using any adhesive or bonding material.

The sprinkler head paint guard 100 is dimensioned to allow its placement over a fire sprinkler head assembly 300 of an automatic fire sprinkler system. Fire sprinkler head assemblies 300 are manufactured having different sizes and shapes and thus, the size and shape of the sprinkler head paint guard 100 can be easily adapted to accommodate a large variety of different sprinkler heads. In one non-limiting embodiment, sprinkler head paint guard 100 comprises a dimensional configuration that includes a diameter (identified by a reference "D2") of 3 inches, an inner diameter (identified by a reference "D1") of 1⅞ inches, and a height (identified by a reference "H") of 3 inches, as better illustrated in FIGS. 2 and 3. Other dimensions can be used to provide paint guards 10 having different sizes.

Figure 4:
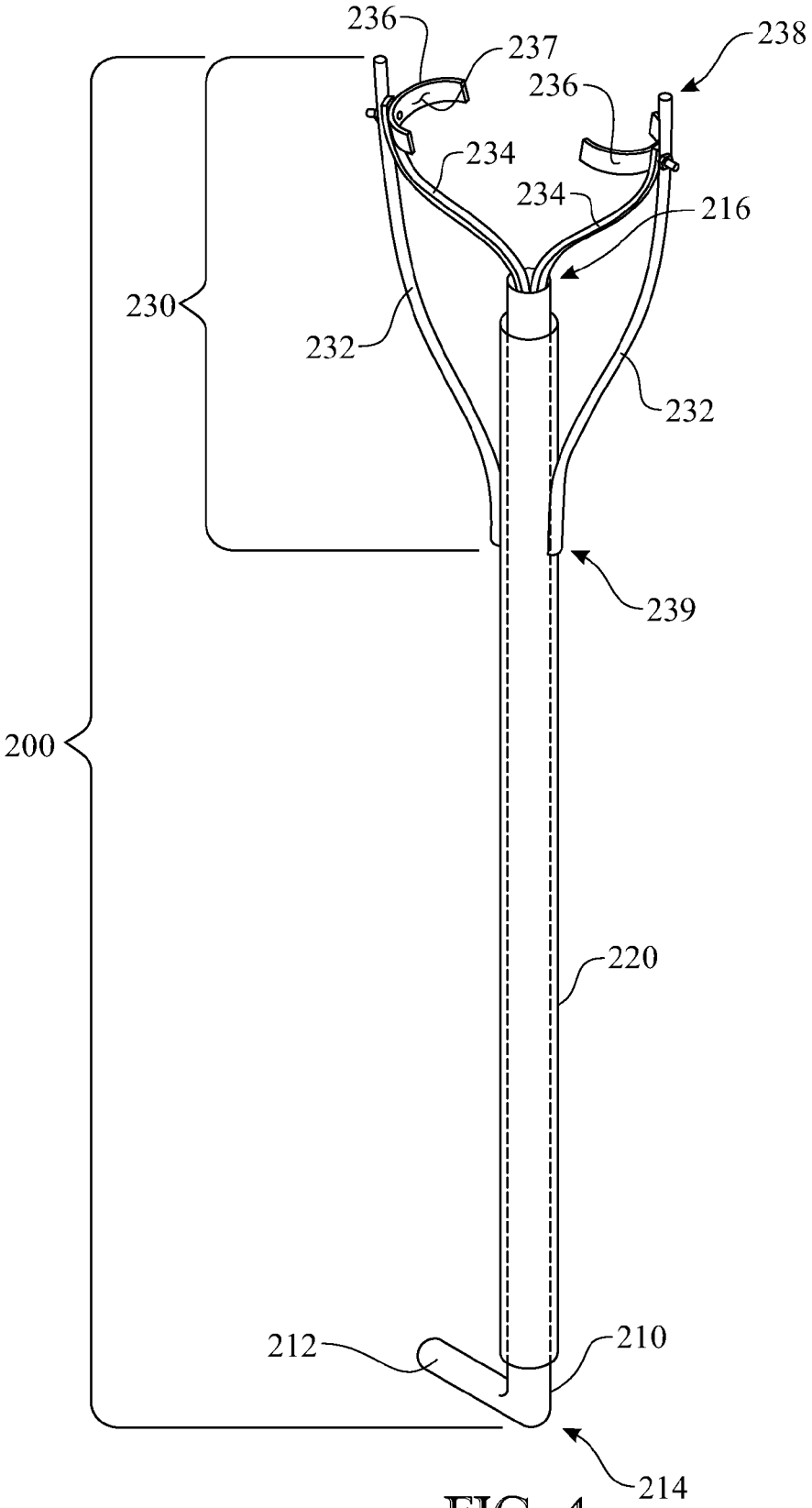
FIG. 4 presents an isometric view of an exemplary installation tool for temporarily attaching the paint guard to a sprinkler head of an automatic sprinkler system, in accordance with the embodiment of the present invention.

A perspective view of an exemplary installation tool 200 used for installing a sprinkler head paint guard 100 over a sprinkler head assembly 300 is illustrated in FIG. 4, in accordance with the embodiment of the present invention. The installation tool 200 includes a hollow, elongated outer sleeve 220 slideably assembled over an elongated inner shaft 210, wherein the outer sleeve 220 is configured to slide axially over the elongated inner shaft 210. The elongated inner shaft 210 and respective hollow, elongated outer sleeve 220 can have a length approximately between 3 and 4 feet. The outer sleeve 220 can include grasping enhancements such as dimples or ridges or an outer coating of material such as rubber to provide a firm frictional grip when held in a user's hands. The grip helps to prevent the installation tool 200 from slipping in the hands of a user during use.

The elongated inner shaft 210 can include an end handle 212 located at a shaft user interface end 214 of the elongated inner shaft 210. The handle 212 can be provided in any suitable configuration. A set of inner slide bushings (not shown) can be provided between the elongated inner shaft 210 and the outer sleeve 220 to allow the elongated inner shaft 210 to slide more easily within outer sleeve 220. A bias mechanism (not shown) is provided within the outer sleeve 220 and designed to bias the inner shaft towards the proximal end of the handle 212 where gripping arched sections 236 come together in a rested state. Examples of a bias mechanism can include one or more springs, a recoil mechanism, an elastic member, and the like.

Figure 6:
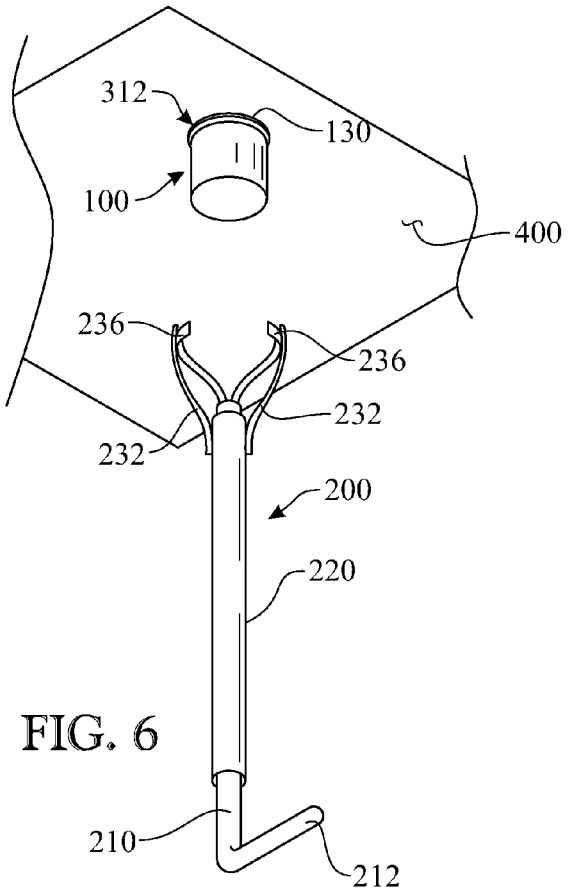
FIG. 6 presents an isometric view of the paint guard securely attached to the annular rim of the sprinkler head, with the installation tool releasably detached from the paint guard, in accordance with the present invention.

The installation tool 200 includes a pair of gripping arm subassemblies 230. Each gripping arm subassembly 230 includes an inner control arm segment 234 operationally assembled to an operational outer control arm segment 232 at a location proximate an operational control arm free end 238. Each gripping arm subassembly 230 further includes a gripping arched section 236 attached to at least one of the operational outer control arm segment 232 and the inner control arm segments 234 at a location nearing the operational control arm free end 238 thereof. The gripping arched sections 236 are configured to grasp onto the circular wall exterior surface 114 of the cylindrical body 110 of the sprinkler head paint guard 100 when installing the sprinkler head paint guard 100 onto the sprinkler head assembly 300 or removing the sprinkler head paint guard 100 from the sprinkler head assembly 300, as illustrated in FIGS. 5 and 6. Each gripping arched section 236 includes a concave gripping surface 237, preferably having a semi-circularly shaped surface, which complements the outer contour or the circular wall exterior surface 114 of the circular wall 112 of the sprinkler head paint guard 100. Each of the gripping arched sections 236 can include a rubber coating or any other suitable frictional material that is designed to provide a firm grip when the gripping arched sections 236 engage with the outer surface (such as the circular wall exterior surface 114) of the sprinkler head paint guard 100. The gripping arched sections 236 can be integrally formed with the operational outer control arm segments 232 or can be separately attached to each operational outer control arm segment 232, respectively, using any known suitable attachment configuration, including molding, fastening, welding, adhesives, a mechanical interface, bonding techniques or the like. It will be noted that the outer surface of the sprinkler head paint guard 100 can also include friction enhanced materials or formations such as dimples or ridges enhancing a gripping force applied by the gripping arched sections 236 to firmly hold onto the circular wall exterior surface 114 of the sprinkler head paint guard 100 to prevent the sprinkler head paint guard 100 from slipping between the gripping arched sections 236.

A first inner control arm segment 234 has an end, proximate the operational control arm free end 238, attached to a like end of an operational outer control arm segment 232, and an opposite end attached to a shaft operational end 216 of elongated inner shaft 210. A second inner control arm segment 234 includes one end attached to the operational outer control arm segment 232, and another end attached to the shaft operational end 216 of elongated inner shaft 210. The inner control arm segments 234 are configured to pivot or swing about the shaft operational end 216 of the elongated inner shaft 210 to pull or push each gripping arched section 236. The inner control arm segments 234 can be fabricated using straps, rods, plates, bars, bands, or the like.

In operation, an individual user grasps the outer sleeve 220 with one hand and, with the other hand, pushes the handle 212 inwards slideably urging the elongated inner shaft 210 axially within an interior of the outer sleeve 220 causing the shaft operational end 216 to extend from an analogous end of the outer sleeve 220. The applied pushing force is strong enough to overcome the bias force provided by the bias mechanism. The sliding motion drives the inner control arm segments 234 upward. The inner control arm segments 234 are restrained by their attachment to the operational outer control arm segment 232, resulting in an outward motion. The resulting outward motion separates the gripping arched sections 236 from one another.

Conversely, to allow the gripping arched sections 236 to close, the user simply pulls handle 212 rearward towards the shaft user interface end 214, or allows the bias mechanism to draw the elongated inner shaft 210 forward, towards the shaft operational end 216 of the outer sleeve 220. As the elongated inner shaft 210 slides within the outer sleeve 220, inner control arm segments 234 are forced to pivot and come together. As the inner control arm segments 234 are brought together, the inner control arm segments 234 each pull the operational control arm free end 238 of the operational outer control arm segment 232 towards one another, respectively, where the operational outer control arm segments 232 are cantilevered from the operational control arm affixed end 239, forcing the gripping arched sections 236 to close and come together. Thus, a user simply manipulates handle 212 to separate and draw together the gripping arched sections 236.

In a preferred embodiment, the installation tool 200 is constructed from a durable, lightweight material. For example, the outer sleeve 220 can be constructed from an extruded section of polyvinyl chloride (PVC) or other suitable plastic. The elongated inner shaft 210 can be constructed from a tubular metal or plastic material. The operational outer control arm segment 232 and inner control arm segments 234 can be constructed from a metal or plastic material. The gripping arched sections 236 can be fabricated of a composition of materials, including a rigid or semi-rigid base material and a grip enhancing material applied on a contacting surface thereof.

In one non-limiting example, the structural features of the installation tool 200 can be constructed from aluminum or the combination of plastic and aluminum. The installation tool 200 is designed for repeated use in painting environments.

A perspective view of the installation tool 200 is show in FIG. 5. The illustration presents the installation tool 200 in use, installing the sprinkler head paint guard 100 over the fire sprinkler head assembly 300 attached to a ceiling 400. To initially grasp the sprinkler head paint guard 100, a user simply pushes the handle 212 forward forcing the elongated inner shaft 210 to axially slide within an interior of the outer sleeve 220 towards the distal end or shaft operational end 216 of the outer sleeve 220. The inner control arm segments 234 push against the respective operational outer control arm segments 232, respectively, separating the gripping arched sections 236 from one another. The gripping arched sections 236 are oriented to engage the outer surface 114 of the sprinkler head paint guard 100. The sprinkler head paint guard 100 can be disposed between gripping arched sections 236 by hand, or alternatively, the sprinkler head paint guard 100 can be placed on a generally horizontal surface such as a floor or chair for easy access. Once the sprinkler head paint guard 100 is positioned between the gripping arched sections 236, the user pulls the handle 212 to force the operational outer control arm segments 232 to come together via, the inner control arm segments 234. The gripping arched sections 236 come together to securely hold the sprinkler head paint guard 100.

With the sprinkler head paint guard 100 securely held between the pair of gripping arched sections 236, the user holds onto the outer sleeve 220 with both hands, and lifts the installation tool 200 in an upward direction, generally denoted by reference identifier "A", to attach the sprinkler head paint guard 100 over the sprinkler head assembly 300. The sprinkler head 310 fits through the inner annular peripheral edge 124 and within the receptacle 118 of the sprinkler head paint guard 100.

As shown in FIG. 6, the annular magnet 130 of the sprinkler head paint guard 100, is magnetically attracted to the annular mounting ring 312 of the sprinkler head assembly 300. The magnetic bond between the annular magnet 130 and the annular mounting ring 312 forms a tight seal therebetween preventing paint, paint mist, and/or other debris from penetrating the sprinkler head paint guard 100, thus avoiding any contamination of the sprinkler head assembly 300. Once the sprinkler head paint guard 100 is securely positioned in place, the user slightly pushes handle 212 upwards to separate the operational outer control arm segments 232, thus disengaging the installation tool 200 from the sprinkler head paint guard 100.

After the ceiling has been painted, the installation tool 200 is reused to easily remove each sprinkler head paint guard 100 from the sprinkler head assembly 300. Because the sprinkler head paint guard 100 is not directly handled by the painter's hands, painters can quickly remove the sprinkler head paint guard 100 from a sprinkler head assembly 300 even though the paint is not yet dry. The user repeats the steps for attaching the sprinkler head paint guard 100 by simply moving handle 212 upwards forcing the gripping arched sections 236 to separate and orients the installed sprinkler head paint guard 100 between the gripping arched sections 236. The user subsequently pulls the handle 212 rearward drawing the gripping arched sections 236 together to engage the body of the sprinkler head paint guard 100. Using both hands, the user pulls downward on the outer sleeve 220 of the installation tool 200 to remove the sprinkler head paint guard 100. The attracting force temporarily provided between the annular magnet 130 and annular mounting ring 312 of the sprinkler head assembly 300 gives way as a downward force is applied to the sprinkler head paint guard 100, thus separating the annular magnet 130 from annular mounting ring 312.

The present invention provides in combination, a sprinkler head paint guard 100 and installation tool 200 to assist painters in protecting fire sprinkler heads 50 when painting ceilings in residential and commercial buildings. The sprinkler head paint guard 100 and installation tool 200 saves money and time by eliminating the need for protecting sprinkler heads with conventional devices including plastic wraps, or adhesive paint guards, and provides painters with a hands-free method of quickly installing paint guards 10 without the need for a ladder. The sprinkler head paint guard 100 is configured to provide a substantial, magnetic contiguous seal used to prevent debris, paint, and/or paint mist from penetrating the sprinkler head paint guard 100 and coming in contact with the sprinkler head assembly 300, thus avoiding a condition where the debris, paint, and/or paint mist could possibly clog or damage the operative function of the sprinkler head assembly 300.

Although the present invention is described as utilizing a magnetized material for the annular magnet 130, it is understood that the magnetized surface 138 can alternatively be fabrication of any suitable temporary adhesive material.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

What I claim is:

1. A sprinkler head paint guard and installation tool combination for use in temporarily protecting sprinkler heads of an automatic fire sprinkler system, said sprinkler head paint guard and installation tool, in combination, comprising;

said sprinkler head paint guard comprising:

a base having a peripheral edge, a tubular wall extending between a first tubular wall end and a second tubular wall end, said first tubular wall end extending generally perpendicularly from said base peripheral edge, and a flange extending radially outward from said second tubular wall end defining an attachment surface, wherein said flange is bound by an outer peripheral edge, said flange being sized to engage with an mounting flange of a fire fighting sprinkler head assembly, and a magnetized material carried by said flange attachment surface, wherein said tubular wall and said base define a receptacle extending inward from said second tubular wall end and said receptacle having a size and shape adapted to cover a sprinkler head of said fire fighting sprinkler head assembly; and an installation tool including:

an outer sleeve having a longitudinal aperture extending axially through a central region of said outer sleeve;

an inner shaft slidably assembled within said longitudinal aperture, said inner shaft extending between a shaft operational end and a shaft user interface end;

a pair of gripping arm subassemblies, each gripping arm subassembly comprising:

an operational outer control arm segment extending between an operational control arm affixed end and an operational control arm free end, wherein said operational control arm affixed end is coupled to said outer sleeve;

an inner control arm segment extending between an inner control arm affixed end and an inner control arm free end, wherein said inner control arm affixed end is coupled to said elongated inner shaft and said inner control arm free end is affixed to said operational outer control arm segment proximate said operational control arm free end;

a gripping arched section carried by at least one of:

said operational outer control arm segment at a location proximate said operational control arm free end, and said inner control arm segment at a location proximate said inner control arm free end; and wherein said inner shaft is manipulated to force said gripping arched sections to releasably engage an exterior surface of said tubular wall of said sprinkler head paint guard.

2. A sprinkler head paint guard and installation tool combination as recited in claim 1, said inner shaft further comprising a handle carried by said inner shaft user interface end of said shaft.

3. A sprinkler head paint guard and installation tool combination as recited in claim 1, said gripping arched section further comprising a concave surface.

4. A sprinkler head paint guard and installation tool combination as recited in claim 3, said gripping arched section further comprising a friction enhancing material disposed upon said gripping surface.

5. A sprinkler head paint guard and installation tool combination as recited in claim 1, wherein said base and tubular wall are fabricated having a unitary construction.

6. A sprinkler head paint guard and installation tool combination as recited in claim 1, wherein said base, tubular wall, and flange are fabricated having a unitary construction.

7. A sprinkler head paint guard and installation tool combination as recited in claim 1, wherein said magnetized material is embedded within said flange.

8. A sprinkler head paint guard and installation tool combination for use in temporarily protecting sprinkler heads of an automatic fire sprinkler system, said sprinkler head paint guard and installation tool, in combination, comprising;

said sprinkler head paint guard comprising:

a base having a peripheral edge, a tubular wall extending between a first tubular wall end and a second tubular wall end, said first tubular wall end extending generally perpendicularly from said base peripheral edge, and a flange extending radially outward from said second tubular wall end defining an attachment surface, wherein said flange is bound by an outer peripheral edge, said flange being sized to engage with an mounting flange of a fire fighting sprinkler head assembly, and a magnetized material provided in a form of a frame extending between an inner peripheral edge and an outer peripheral edge, said magnetized material frame being assembled to said flange attachment surface, wherein said tubular wall and said base define a receptacle extending inward from said second tubular wall end and said receptacle having a size and shape adapted to cover a sprinkler head of said fire fighting sprinkler head assembly; and an installation tool including:

an outer sleeve having a longitudinal aperture extending axially through a central region of said outer sleeve;

an inner shaft slidably assembled within said longitudinal aperture, said inner shaft extending between a shaft operational end and a shaft user interface end;

a pair of gripping arm subassemblies, each gripping arm subassembly comprising:

an operational outer control arm segment extending between an operational control arm affixed end and an operational control arm free end, wherein said operational control arm affixed end is coupled to said outer sleeve;

an inner control arm segment extending between an inner control arm affixed end and an inner control arm free end, wherein said inner control arm affixed end is coupled to said elongated inner shaft and said inner control arm free end is affixed to said operational outer control arm segment proximate said operational control arm free end;

a gripping arched section carried by at least one of:

said operational outer control arm segment at a location proximate said operational control arm free end, and said inner control arm segment at a location proximate said inner control arm free end; and wherein said inner shaft is manipulated to force said gripping arched sections to releasably engage an exterior surface of said tubular wall of said sprinkler head paint guard.

9. A sprinkler head paint guard and installation tool combination as recited in claim 8, said inner shaft further comprising a handle carried by said inner shaft user interface end of said shaft.

10. A sprinkler head paint guard and installation tool combination as recited in claim 8, said gripping arched section further comprising a concave surface.

11. A sprinkler head paint guard and installation tool combination as recited in claim 10, said gripping arched section further comprising a friction enhancing material disposed upon said gripping surface.

12. A sprinkler head paint guard and installation tool combination as recited in claim 8, wherein said base and tubular wall are fabricated having a unitary construction.

13. A sprinkler head paint guard and installation tool combination as recited in claim 8, wherein said base, tubular wall, and flange are fabricated having a unitary construction.

14. A sprinkler head paint guard and installation tool combination for use in temporarily protecting sprinkler heads of an automatic fire sprinkler system, said sprinkler head paint guard and installation tool, in combination, comprising;

said sprinkler head paint guard comprising:

a base having a circular peripheral edge, a cylindrical tubular wall extending between a first tubular wall end and a second tubular wall end, said first tubular wall end extending generally perpendicularly from said base peripheral edge, and an annular flange extending radially outward from said second tubular wall end defining an attachment surface, wherein said annular flange is bound by a circular outer peripheral edge, said annular flange being sized to engage with an annular mounting ring of a fire fighting sprinkler head assembly, and a magnetized material carried by said flange attachment surface, wherein said tubular wall and said base define a receptacle extending inward from said second tubular wall end and said receptacle having a size and shape adapted to cover a sprinkler head of said fire fighting sprinkler head assembly; and an installation tool including:

an outer sleeve having a longitudinal aperture extending axially through a central region of said outer sleeve;

an inner shaft slidably assembled within said longitudinal aperture, said inner shaft extending between a shaft operational end and a shaft user interface end;

a pair of gripping arm subassemblies, each gripping arm subassembly comprising:

an operational outer control arm segment extending between an operational control arm affixed end and an operational control arm free end, wherein said operational control arm affixed end is coupled to said outer sleeve;

an inner control arm segment extending between an inner control arm affixed end and an inner control arm free end, wherein said inner control arm affixed end is coupled to said elongated inner shaft and said inner control arm free end is affixed to said operational outer control arm segment proximate said operational control arm free end;

a gripping arched section comprising a concave gripping surface, said gripping arched section carried by at least one of:

said operational outer control arm segment at a location proximate said operational control arm free end, and said inner control arm segment at a location proximate said inner control arm free end; and wherein said inner shaft is manipulated to force said gripping arched sections to releasably engage an exterior surface of said tubular wall of said sprinkler head paint guard.

15. A sprinkler head paint guard and installation tool combination as recited in claim 14, said inner shaft further comprising a handle carried by said inner shaft user interface end of said shaft.

16. A sprinkler head paint guard and installation tool combination as recited in claim 14, said gripping arched section further comprising a friction enhancing material disposed upon said gripping surface.

17. A sprinkler head paint guard and installation tool combination as recited in claim 14, wherein said base and tubular wall are fabricated having a unitary construction.

18. A sprinkler head paint guard and installation tool combination as recited in claim 14, wherein said base, tubular wall, and flange are fabricated having a unitary construction.

19. A sprinkler head paint guard and installation tool combination as recited in claim 14, wherein said magnetized material is embedded within said flange.

20. A sprinkler head paint guard and installation tool combination as recited in claim 14, wherein said magnetized material is provided in a form of a frame extending between an inner peripheral edge and an outer peripheral edge, said magnetized material frame being assembled to said flange attachment surface.

* * * * *